US011758993B2

(12) United States Patent
Mayer

(10) Patent No.: US 11,758,993 B2
(45) Date of Patent: Sep. 19, 2023

(54) HOLDING DEVICE FOR CARDS AND/OR BANK NOTES

(71) Applicant: Frank F. E. Mayer, Bad Duerkheim (DE)

(72) Inventor: Frank F. E. Mayer, Bad Duerkheim (DE)

( * ) Notice: Subject to any disclaimer, the term of this patent is extended or adjusted under 35 U.S.C. 154(b) by 391 days.

(21) Appl. No.: 16/631,966

(22) PCT Filed: Aug. 15, 2018

(86) PCT No.: PCT/EP2018/072098
§ 371 (c)(1),
(2) Date: Jan. 17, 2020

(87) PCT Pub. No.: WO2019/034681
PCT Pub. Date: Feb. 21, 2019

(65) Prior Publication Data

US 2020/0163424 A1 May 28, 2020

(30) Foreign Application Priority Data

Aug. 18, 2017 (DE) ..... 20 2017 104 987.6
Sep. 11, 2017 (DE) ..... 20 2017 105 482.9

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01); *A45C 2001/062* (2013.01); *A45C 2001/065* (2013.01); *A45C 2001/067* (2013.01)

(58) Field of Classification Search
CPC ... A45C 1/06; A45C 11/182; A45C 2001/062; A45C 2001/065; A45C 2001/067; B42F 1/04
See application file for complete search history.

(56) References Cited

U.S. PATENT DOCUMENTS 501,279 A * 7/1893 Knight ..... A45C 11/18 206/39
1,194,360 A 8/1916 Conley
(Continued)

FOREIGN PATENT DOCUMENTS

CA 2 854 394 A1 5/2013
CN 201243708 Y 5/2009
(Continued)

OTHER PUBLICATIONS

International Search Report in PCT/EP2018/072098, dated Nov. 28, 2018.
(Continued)

*Primary Examiner* — John K Fristoe, Jr.
*Assistant Examiner* — Justin Caudill
(74) *Attorney, Agent, or Firm* — Collard & Roe, P.C.

(57) ABSTRACT

A holding device for cards and/or bank notes, contains an upwardly open housing including a bottom, the bottom including upwardly projecting side strips arranged at a distance from each other. All types of cards and/or bank notes can be received in the holding device in a permanently reliable manner and such that the material thereof is protected as far as possible. To this end, the side strips together with the bottom form a slide-in compartment that has a slide-in width along a defined grip length, at least in sections, which is larger than 52 mm and smaller than 53.98 mm.

26 Claims, 16 Drawing Sheets

(56) References Cited

Figure 1A:
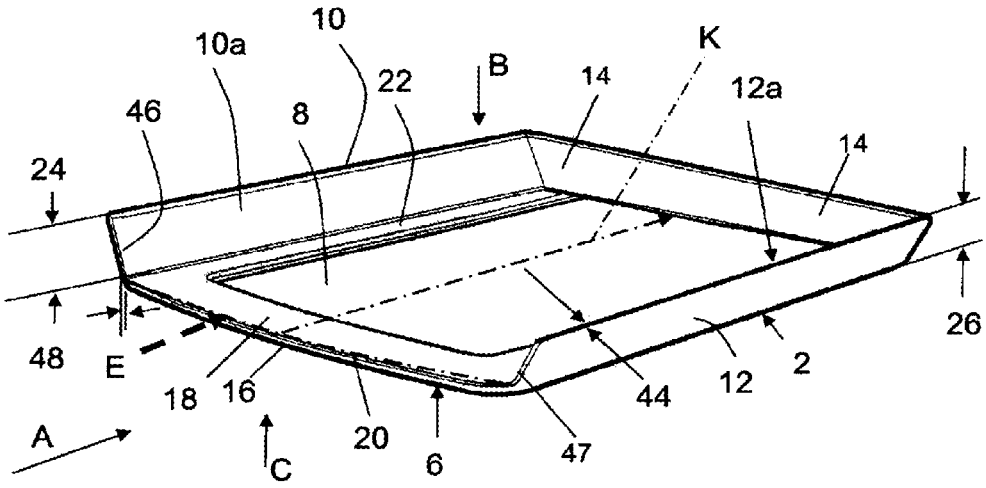
Figure 1A:
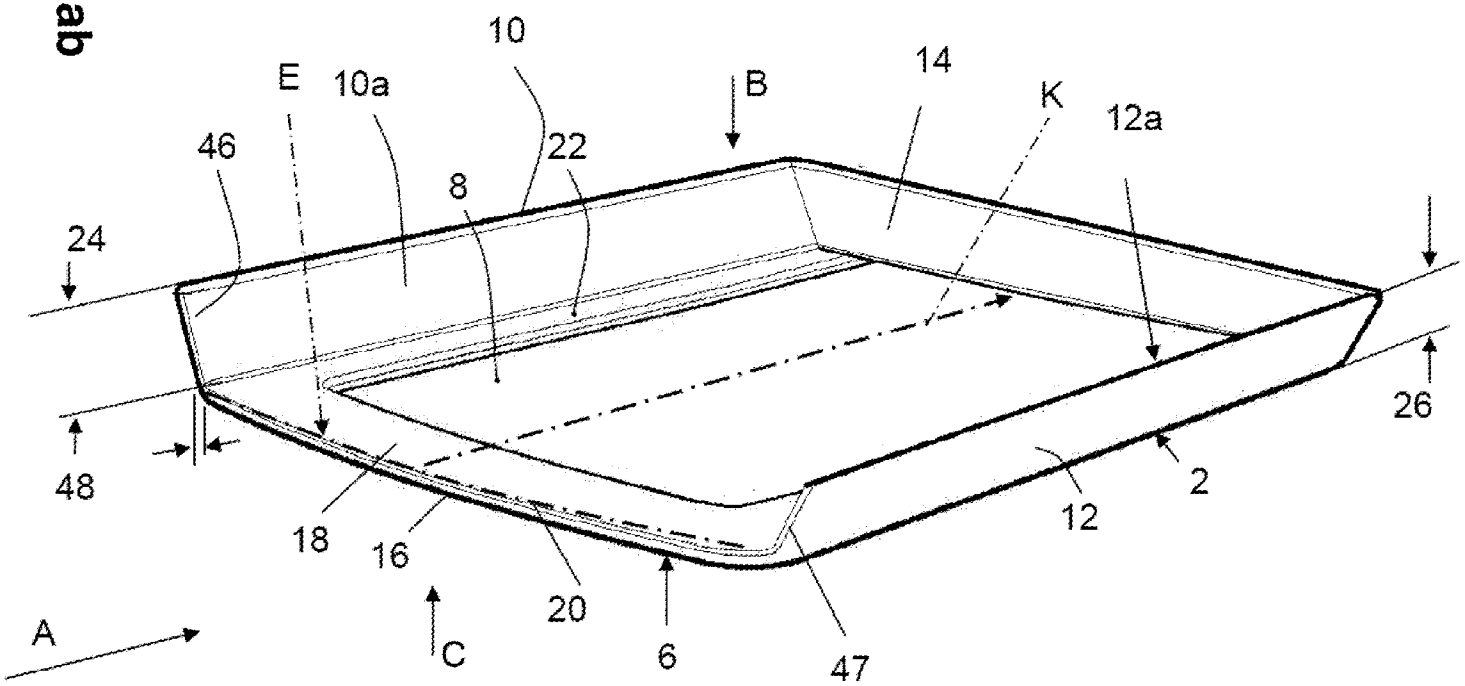

U.S. PATENT DOCUMENTS 1,466,729 A * 9/1923 Riley ..... A45C 11/18 206/39.6
1,851,013 A 3/1932 Michaud et al.
2,686,545 A * 8/1954 Fontana ..... A45C 1/06 150/137
3,109,538 A * 11/1963 Boxer ..... A61B 13/00 206/39.6
3,416,586 A 12/1968 Voss
D213,236 S 1/1969 Zacharia
3,543,918 A 12/1970 Waterman et al.
4,056,139 A 11/1977 Murt
4,141,400 A * 2/1979 Mangan ..... A45C 11/182 206/39.6
4,170,914 A 10/1979 Carrier
4,691,456 A * 9/1987 Ackeret ..... B42F 7/14 40/721
4,903,376 A * 2/1990 Rousseau ..... B42F 1/00 150/137
5,020,255 A 6/1991 Rodel
D317,983 S 7/1991 Gilbreath
5,038,926 A * 8/1991 van der Toorn ..... B42F 7/00 150/147
5,238,150 A 8/1993 Williams
5,358,019 A 10/1994 Sumner, III
5,409,133 A 4/1995 Gringer
5,520,230 A 5/1996 Summer, III
5,718,329 A 2/1998 Ippolito et al.
5,938,010 A 8/1999 Osterbye
6,026,873 A 2/2000 Van Geer
6,089,289 A * 7/2000 Florjancic ..... A45C 11/182 206/39.6
6,155,410 A * 12/2000 Davis ..... A45C 11/182 150/147
6,173,837 B1 1/2001 Marconi
6,427,837 B1 8/2002 Shields
6,435,236 B2 * 8/2002 Gribovsky ..... A45C 11/182 150/147
6,592,003 B2 7/2003 Silverthorne
D505,355 S 5/2005 Elnekaveh
D525,162 S 7/2006 Suman
7,308,771 B2 * 12/2007 Memelink ..... G09F 3/20 150/147
7,331,366 B1 2/2008 Patterson
7,334,616 B2 2/2008 Kaminski
7,617,928 B1 11/2009 Murphy
8,464,865 B1 6/2013 Dumont et al.
8,899,411 B2 12/2014 Van Geer
9,615,641 B2 * 4/2017 Yeung ..... A45C 13/007
9,661,908 B2 * 5/2017 Mayer ..... A45C 1/06
11,246,388 B2 * 2/2022 Mayer ..... A45C 11/182
2005/0023157 A1 * 2/2005 Logan ..... A45C 11/18 206/39
2005/0199710 A1 9/2005 Richter
2006/0076094 A1 4/2006 Kaminski
2007/0089999 A1 4/2007 Decker et al.
2008/0178976 A1 7/2008 Lakhiani
2009/0045091 A1 2/2009 O'Neill et al.
2010/0038000 A1 2/2010 Ho
2010/0065171 A1 3/2010 Uzelac
2010/0243509 A1 9/2010 Gelardi
2013/0104350 A1 * 5/2013 Vlasdeck ..... A45C 15/04 24/489
2014/0020798 A1 * 1/2014 Kitchen ..... A45C 11/182 150/137
2014/0060712 A1 * 3/2014 Beckley ..... A45C 1/06 150/133
2014/0096880 A1 4/2014 Yeung et al.
2014/0284095 A1 9/2014 Behuniak et al.
2014/0284227 A1 * 9/2014 Mayer ..... A45C 1/06 206/39
2014/0373986 A1 * 12/2014 Parrill ..... A45C 1/00 150/132
2015/0059936 A1 * 3/2015 Singer ..... A45C 13/023 442/131
2015/0351506 A1 * 12/2015 Smith, II ..... B29C 51/266 150/132
2016/0045006 A1 2/2016 Moon
2016/0255932 A1 * 9/2016 Hsieh ..... A45C 1/06
2017/0026070 A1 * 1/2017 Hodroj ..... A45C 11/182
2017/0135452 A1 5/2017 Kane
2017/0202324 A1 * 7/2017 Van Geer ..... A45C 1/06
2018/0368544 A1 12/2018 King
2019/0104830 A1 4/2019 Cortellacci et al.

FOREIGN PATENT DOCUMENTS

CN 104010544 A 8/2014
CN 204207238 U 3/2015
CN 205671677 U 11/2016
CN 206013427 U 3/2017
EP 0 337 452 A2 10/1989
EP 2 773 235 B1 8/2015
JP S5468951 U 5/1979
JP S63-185624 U 11/1988
JP H02-10979 U 1/1990
JP 3034461 U 2/1997
JP H10-248620 A 9/1998
JP 3129373 U 2/2007
JP 2014-155135 A 8/2014
JP 2014-532490 A 12/2014
KR 20-0373787 Y1 1/2005
RU 123 302 U1 12/2012
WO 03/053188 A1 7/2003
WO 2005/058090 A1 6/2005
WO 2007/108800 A1 9/2007
WO WO-2010137975 A2 * 12/2010 ..... A45C 11/182
WO 2019/071030 A1 4/2019
WO 2019/238731 A1 12/2019

OTHER PUBLICATIONS

English translation of the International Preliminary Report on Patentability and Written Opinion of the International Searching Authority in PCT/EP2018/072098, dated Feb. 18, 2020.
Canadian Examination Search Report in Canadian Application No. 3,071,482 dated Apr. 19, 2021.
Chinese Office Action with Search Report in CN 201880053681.4, dated Apr. 1, 2021.
Japanese Office Action in JP 2020-530726, dated Jun. 28, 2022, with English translation.

* cited by examiner

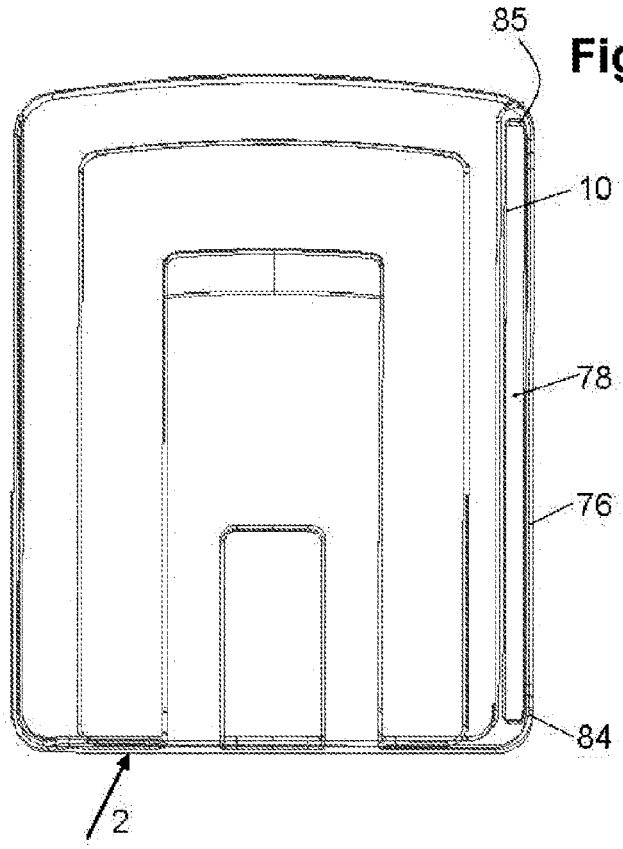
Fig. 15
Fig. 16
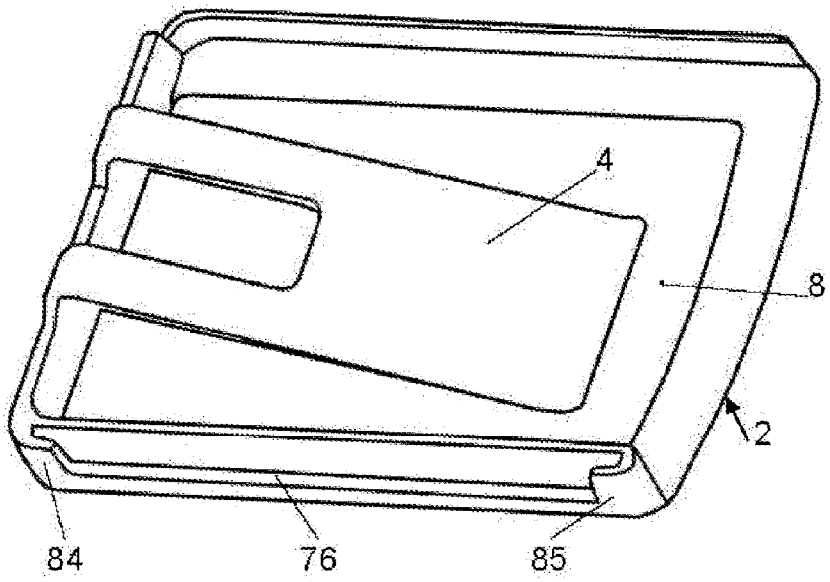

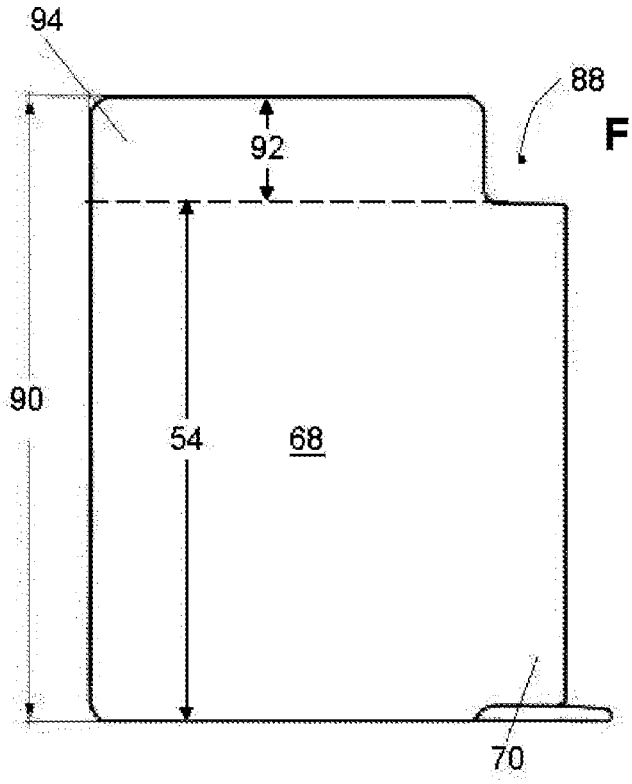
Fig. 17
Fig. 18
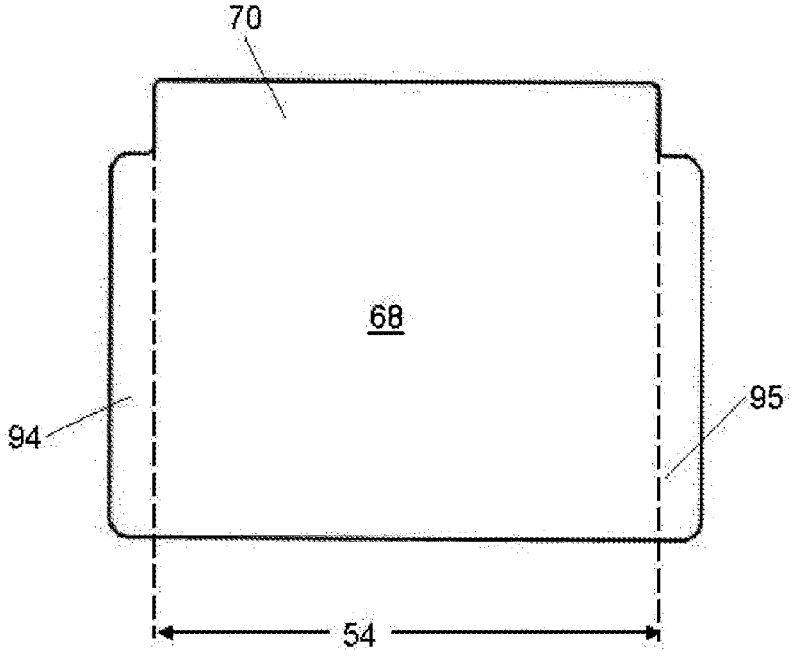

HOLDING DEVICE FOR CARDS AND/OR BANK NOTES

CROSS REFERENCE TO RELATED APPLICATIONS

This application is the National Stage of PCT/EP2018/072098 filed on Aug. 15, 2018, which claims priority under 35 U.S.C. § 119 of German Application Nos. 20 2017 104 987.6 filed on Aug. 18, 2017 and 20 2017 105 482.9 filed on Sep. 11, 2017, the disclosures of which are incorporated by reference. The international application under PCT article 21(2) was not published in English.

The invention relates to a holding device for cards and/or tickets according to the preamble of claim 1.

A holding device is known from EP 2 773 235 B1, which holding device permits functional storage of cards, in particular of credit cards and/or of tickets, wherein the removal of these from the holding device can be performed without any problems.

Said holding device requires little expenditure of material and has a low overall weight. Furthermore, the known holding device permits the reliable storage both of individual cards and/or of tickets and of a large number of the same.

The known holding device has side members which are arranged parallel to one another and between which cards are received in a stacked manner, wherein a clip acts on the cards from above. Banknotes can be arranged between the clip and the cards.

Cards, in particular credit cards or cards for being loaded with money or so-called loyalty points, ever more commonly have sensitive magnetic strips, chips or laminates, which must be handled as gently as possible.

Also, banknotes, in particular banknotes outside the area of the EU, may be manufactured from very thin paper and in particular have a tendency to tear after a relatively long duration of use.

Against this background, it is a requirement or the object to receive as far as possible all card types and/or banknote types in the holding device in the most material-preserving manner possible and in a permanently reliable manner.

This object is solved according to the features specified in patent claim 1.

According to the invention, the side members together with the base form, at least in certain portions, an insertion compartment which has, at least in certain portions along a defined clamping length, an insertion width which is greater than 52 mm and less than 53.98 mm.

As a result of this undershooting of a conventional credit card width, the cards are subjected to uniform clamping at least along the clamping length as they are inserted into the housing. Even after a relatively long duration of use, the housing can still impart a clamping force even if the material of the housing has become fatigued or stretched.

If the housing were assigned a clip, a spring force that this would need to exert in the direction of the cards in order to fix these in the housing would be considerably reduced, because the lateral clamping of said cards already imparts a fixing action. A relatively weak clip would also preserve sensitive paper money and protect this against tearing. Chips, laminates and magnetic strips of cards would also be preserved.

If a clamping force that a clip must exert is reduced, said clip is subject to less wear and less fatigue. This is related to the fact that a modulus of elasticity that must act in a plastic is reduced. Plastics with a lower modulus of elasticity have a lesser tendency to fatigue and wear out.

The insertion width could widen in an upward direction. In this way, it would be possible for cards to deflect upwards without any problems if they were to have an oversize that disrupts an insertion movement.

Against this background, the insertion width in an upper area could lie between 54 and 54.2 mm and/or widen from 53.98 mm to a value that lies in the range between 54 mm and 54.2 mm. In this way, it would be ensured that conventional credit cards can be received without any problems and nevertheless in an effectively fixed manner.

The clamping length could lie in the range of 3 mm to 85.6 mm. These length ranges have proven to be expedient in order to effect adequate lateral fixing and clamping of cards. What is preferable is a somewhat longer clamping length of 6 mm to 85.6 mm, particularly preferably a long clamping length of 10 mm to 85.6 mm.

The inner contact surfaces of the side members could be arranged parallel to one another at least along the clamping length. In this way, cards are held with clamping action by the side members alone over a particular height.

The inner contact surfaces of the side members could be shaped or inclined such that a card inserted into the housing is received in an upwardly or downwardly bulged manner or so as to be inclined obliquely relative to the base. In this way, a card is held in non-positively locking fashion in the housing with slight deformation.

The base or a part of the base could be, at least in certain portions, reversibly deformable and/or formed so as to be bulged or curved under pretension. In this way, a part of the base can deflect and change its shape in order to compensate, reduce or prevent excessive clamping of a card to be inserted.

The same could be achieved if a connecting member of the housing were, at least in certain portions, reversibly deformable and/or formed so as to be bulged or curved under pretension.

The housing could be manufactured by means of a two-component injection molding process. In this way, individual regions or parts of the housing, in particular a clip thereof, can be manufactured from different materials with different moduli of elasticity. For example, a clip can be manufactured from a relatively elastic plastic, and the rest of the housing can be manufactured from a relatively rigid plastic.

The holding device is characterized by a simple design and provides for a functional storage of cards and/or tickets, wherein the insertion as well as the removal thereof can be carried out without any problems.

A holding device of the type described here could have one or more clips in order to press cards and/or banknotes against the base from above.

At least one clip could be assisted in terms of its damping force by a separate spring means. In this way, a clip can exert an adequate spring force in the direction of the base even if the material thereof exhibits fatigue phenomena.

The separate spring means could be designed as a leaf spring, spiral spring or spring bow. Such spring means are inexpensive and easily workable.

The housing could be embodied in one piece and the clip could be an integral component thereof in a preferred manner. Advantageously, the holding device is embodied as a case and serves to store cards, such as credit cards or bank cards, in particular in the common so-called bank card format, as well as banknotes, documents, memos or the like.

The tickets as well as the cards are clipped in the housing by means of the clip or clips, wherein additional means for separately holding the cards are not required, but may be provided.

The housing furthermore has two side members, which stick out from the base, which are located opposite one another and between which the card or cards can be fixed. If no cards or tickets are arranged in the housing, the clip or clips reach(es) at least approximately to the base of the housing.

The base preferably includes a recess, through which the at least one spring-elastic clip engages or could engage, as long as no cards or tickets are located in the holding device. The area above the base and the members is free and an upper part is not present, so that the clip reaches at least to the base and/or the recess of the base and can preferably at least partially engage through the recess.

In response to inserting a card and/or a ticket, the spring-elastic clip is lifted and pretensioned, so that even only a single card is subsequently held securely or is clipped in the housing, respectively, due to the pretensioning.

The size of the recess is preferably predetermined to be so large that the card or cards can be shifted easily by means of two fingers or thumbs in such a manner that the desired card can be accessed and can be removed easily.

The recess furthermore preferably has a significantly larger width than the clip or clips, namely such that a user can use one finger, for example, to reach through, so as to minimize the pretensioning force exerted on the cards by means of the clip or clips, and to thus be able to remove the desired card from the housing easily, on at least one side or in the area of the tip of the clip.

Advantageously, the mentioned side members have different heights such that tickets or also cards, which are larger than are predetermined by the distance of the side members, such as business cards, for example, can protrude beyond the shorter side member and are secured reliably nonetheless.

In a special embodiment of the invention, provision is additionally made for a cover, in particular a flexible cover, which is fastened to one of the mentioned side members or to a connecting member thereof and which can also be replaced as needed, if necessary.

The housing furthermore includes preferably at least one indentation so as to facilitate the insertion or removal of cards and/or tickets.

Further developments and special embodiments of the holding device according to the invention are specified in the subclaims and the following description of exemplary embodiments.

In different exemplary embodiments, the same reference designations are used for substantially functionally identical elements for reasons of clarity.

The invention will be specified in more detail below by means of special exemplary embodiments, which are illustrated in the drawing, without making a limitation in this regard.

Figure 1:
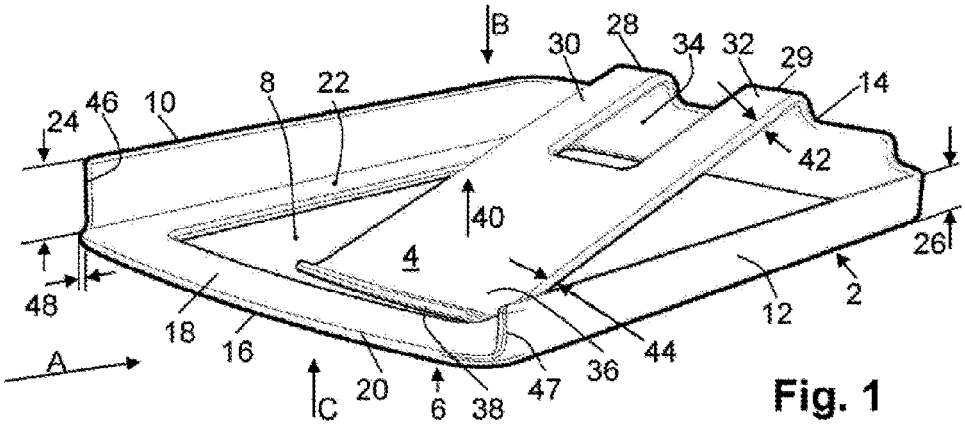
Figure 2:
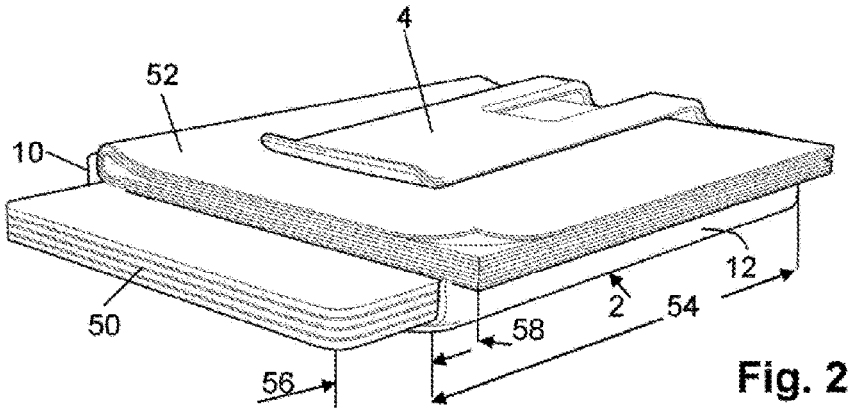
Figure 3:
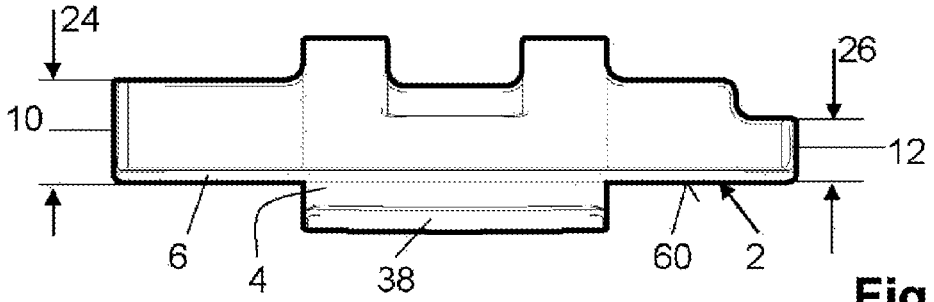
Figure 4:
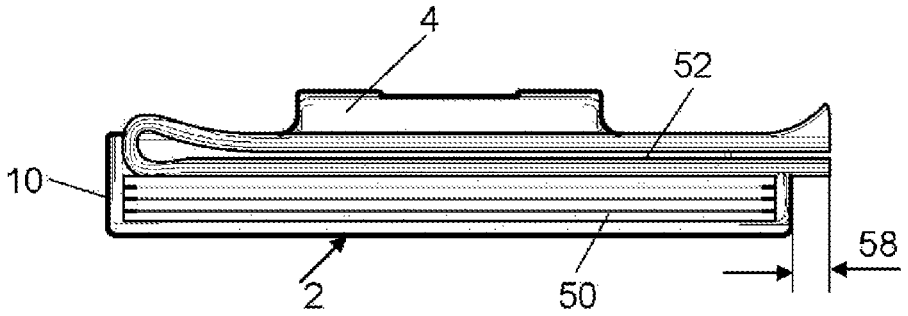
Figure 19:
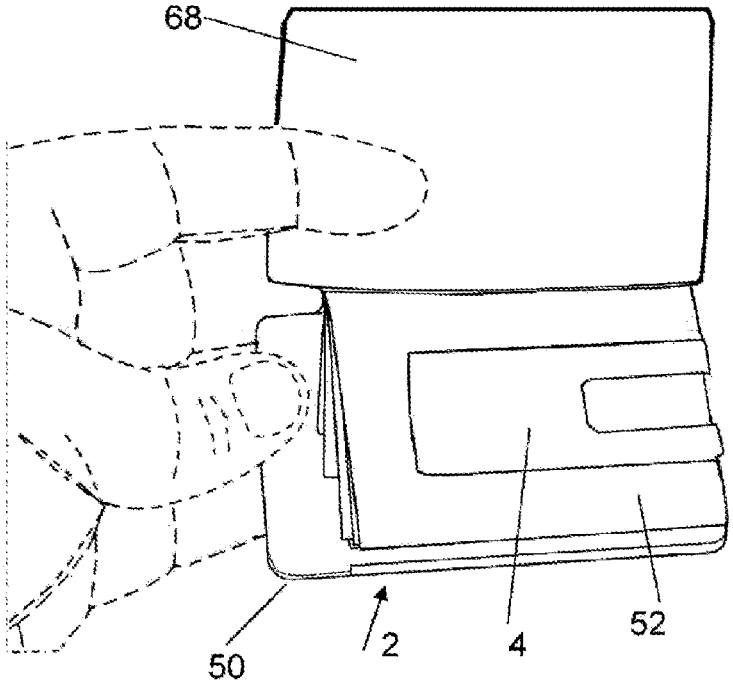
Figure 20:
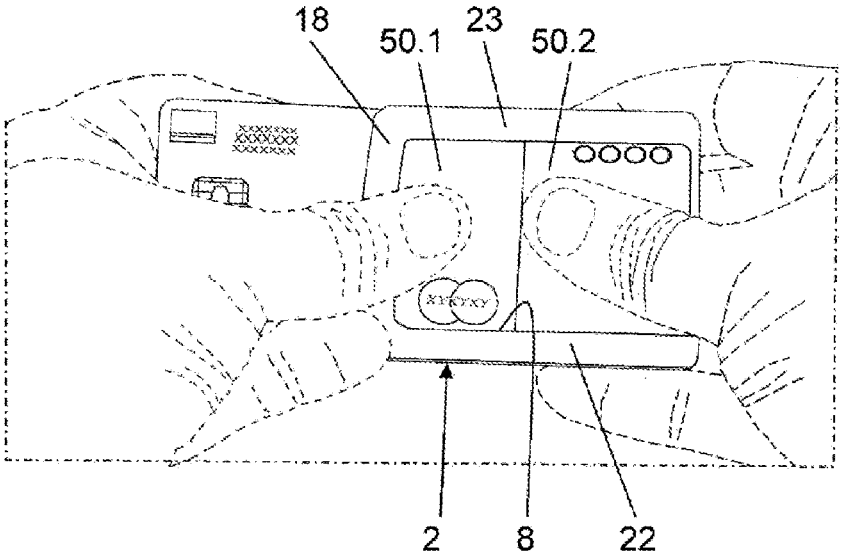
Figure 24:
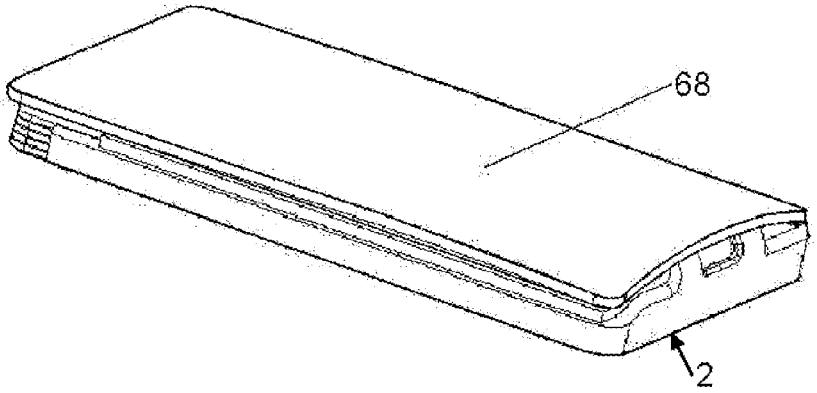
Figure 25:
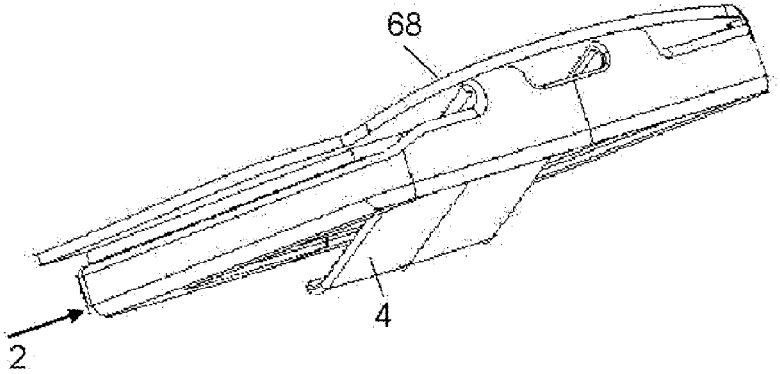
Figure 26:
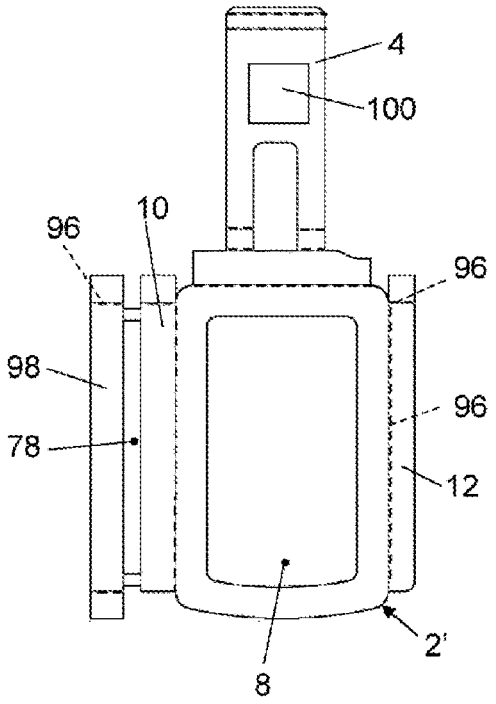
Figure 27:
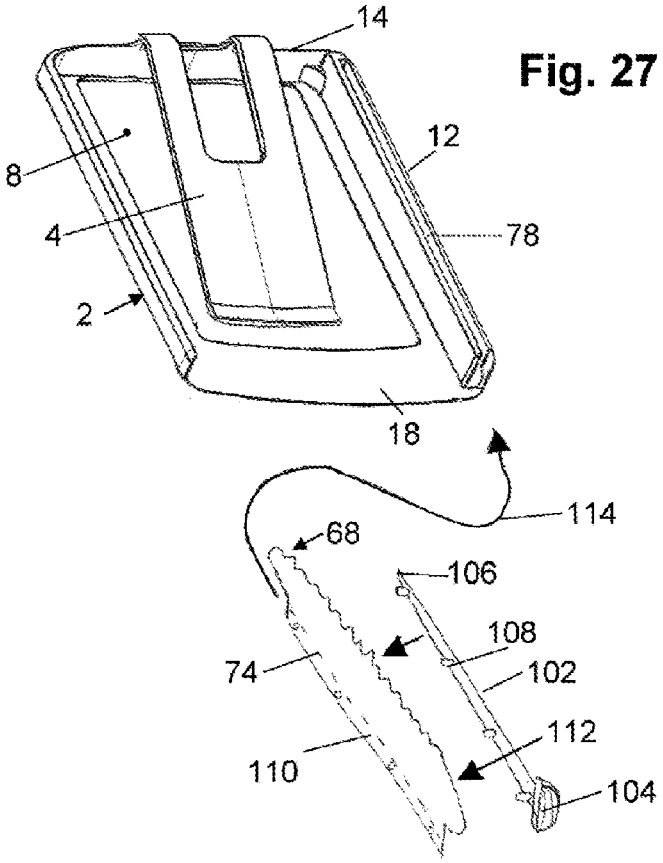
Figure 28:
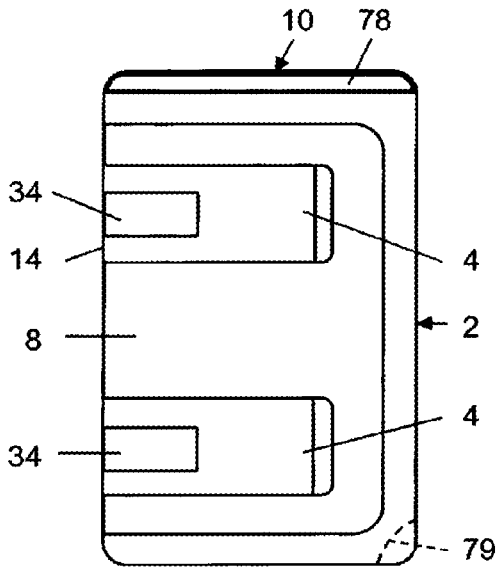
Figure 29:
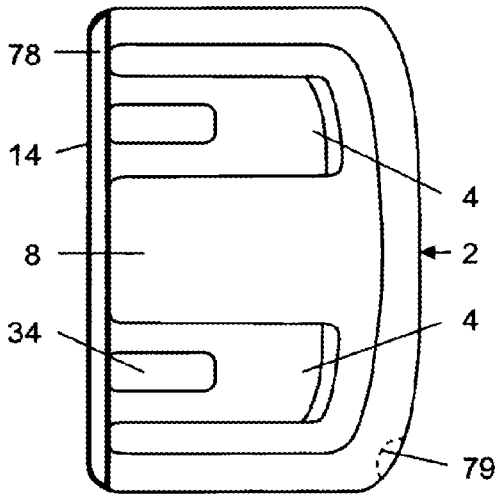

FIG. 1*a* shows a perspective view of a holding device without clip,

FIG. 1*ab* shows a perspective view of the holding device without clip according to FIG. 1*a* in an enlarged illustration, FIG. 1 shows a perspective view of a holding device comprising a sole clip, FIG. 2 shows a view according to FIG. 1 of the holding device comprising cards and tickets stored therein, FIGS. 3, 4 show views in viewing direction A according to FIGS. 1, 2, FIGS. 5, 6 show views onto the holding device in viewing direction B according to FIGS. 1, 2, FIGS. 7, 8 show views of the holding device in viewing direction C according to FIGS. 1, 2, FIGS. 9-11 show perspective views of a special embodiment comprising a cover, FIGS. 12-16 show views of the housing for the special embodiment comprising a cover, FIGS. 17, 18 show exemplary embodiments of the cover, FIG. 19 shows the holding device or the case, respectively, wherein the cover is illustrated in the position, which is lifted or pivoted upwards, FIG. 20 shows a view from the bottom onto the holding device comprising a stack of cards, FIGS. 21-25 show views of an exemplary embodiment comprising a cover, which is illustrated in the closed position, FIG. 26 shows a pre-cut for the production of the housing, which consists of metal, FIG. 27 shows an exemplary embodiment comprising an exchangeable cover, FIGS. 28, 29 show two exemplary embodiments comprising two clips.

FIG. 1*a* or FIG. 1*ab* shows a holding device for cards and/or tickets, comprising an upwardly open housing 2, which has a base 6, wherein the base 6 has side members 10, 12, which protrude upwards and which are arranged at a distance to each other.

The side members 10, 12 together with the base 6 form, at least in certain portions, an upwardly open insertion compartment or a kind of an upwardly open insertion compartment which has, at least in certain portions along a defined clamping length K, an insertion width E which is greater than 52 mm and less than 53.98 mm.

The clamping length K is illustrated in a dot-dash manner in a longitudinal direction of the housing 2. The insertion width E is illustrated in a dot-dash manner in a transverse direction of the housing 2.

The insertion width E widens in continuous fashion in an upward direction. The insertion width E in an upper area lies between 54 and 54.2 mm and widens in continuous fashion from 53.98 mm to a value that lies in the range between 54 mm and 54.2 mm.

The clamping length K lies in the range of 3 mm to 85.6 mm.

The inner contact surfaces 10*a*, 12*a* of the side members 10, may, in a lower area, be arranged parallel to one another along the clamping length K, as illustrated for example in FIG. 1.

The inner contact surfaces 10*a*, 12*a* of the side members 10, 12 are, in FIG. 1*a* or FIG. 1*ab*, shaped or inclined such that a card inserted into the housing 2 is preferably received in an upwardly bulged manner or so as to be inclined obliquely relative to the base 6.

The base 6 is, at least in certain portions, reversibly deformable and is formed so as to be bulged or curved under pretension.

Specifically, the front base part 18 and a rear connecting member 14 of the housing 2 are reversibly deformable and formed so as to be bulged or curved under pretension.

The holding device illustrated in FIG. 1 includes a housing 2 and a sole clip 4, which is connected thereto, in particular integrally. The holding device and/or the case preferably consist(s) of a spring-elastic plastic, such as PES or PSU and/or plastics comprising high processing temperatures and/or high temperature-resistant plastics, which have a low tendency to creep, when they are permanently deformed. Advantageously, the plastics, which are used, can be reinforced with fibers, in particular with carbon fibers. Other plastics can also be provided, such as, for example, POM, ABS, PA (filled with glass fibers or glass beads) or the like.

In the alternative, the holding device can consist of sufficiently spring-elastic metal, such as in particular stainless steel, wherein the spring elasticity of the clip 4 on the one hand and the stability as a whole on the other hand is predetermined in particular by means of the predetermined dimensioning of the thickness of the optional clip 4 but also of the housing 2. The housing 2 is embodied in the manner of a frame and includes a base 6, in which a recess 8 is advantageously provided, as well as a first side member 10 and, located opposite thereto, a second side member 12, which are connected via a connecting member 14. However, there is no member located opposite the connecting member 14, so that, on this end, which will be identified below as front end 16, only the front base part 18 is present, beyond which cards can be inserted into the housing 2 between the opposite side members 10, 12. In an alternative special embodiment, the front base part 18 can also be foregone. The two side members 10, 12 are at a distance relative to one another, which is substantially equal, advantageously slightly larger than the width of typical credit cards, bank cards or the like by a small amount. The side members 10, 12 and the connecting member 14 run substantially in a U-shaped manner and are arranged at least approximately orthogonally to the base 6.

A free space is present above the base 6 and the side members 10, 12, 14 in such a manner that the clip 4 can reach at least to the recess 8 and preferably can at least partially engage through it. It is important to note expressly here that for the exemplary embodiments comprising two clips, which will be explained below, the subsequent explanations relating to one clip also apply analogously for the exemplary embodiments comprising two clips. As long as neither cards nor tickets are located in the housing, the clip 4 engages through the recess 8.

The recess 8 takes up a significant part of the total surface of the base 6, namely preferably significantly more than half of the total surface of the base 6, which is predetermined by the mentioned members 10, 12, 14 and the outer or front edge 20, respectively, of the base part 18. The recess 8, which is also identified as window, is preferably so large and/or is predetermined freely in such a manner that a user can reach through it with two thumbs next to one another and can destack the cards one after the other or can remove them from the holding device, respectively, or the case, respectively. The search for the "correct card" is thus facilitated in an advantageous manner, because in particular the cards, which were pushed to the side, can nonetheless be circumnavigated and that they can be inserted back once more into the holding device or the case easily, respectively, and/or can be guided back easily.

Due to the predetermined large design of the recess 8, it is not only possible to slide the card by means of a thumb or finger, but the cards can be slid or pushed and/or can be pulled simultaneously by means of two thumbs or fingers. This can take place until the desired card is visible, in particular on the top, and can be removed from below on the ejection side and/or on the front end.

The front edge 20 is preferably embodied so as to be rounded and/or curved, so that cards can be inserted easily. The lateral base part 22, from which the first side member 10 sticks out upwards according to the drawing, advantageously has a width, which is advantageously smaller than the height 24 of the first side member 10. The lateral base part, which is assigned to the second side member 12, advantageously has substantially the same width as the lateral base part 22. The height 26 of the second side member 12 is smaller than the height 24 by a predetermined amount, as will be explained in more detail below.

Preferably, however, a base part is not present in the area of the connecting member 14. Due to this asymmetrical design of the side members 10, 12, cards comprising a width, which is larger than is predetermined by the distance of the side members, can be stored in the housing in an advantageous manner.

Advantageously, the sole clip 4 is connected to the connecting member 14 via curved areas 28, 29, wherein the clip 4 has two clip parts 30, 32, which are arranged at a distance from one another, at that location, between which a recess 34 is located. The spring elasticity and/or bendability of the clip 4 is optimized through this.

The connecting member 14 is furthermore an end stop for inserted cards. The clip 4 is embodied so as to be substantially flat and has a free end 36 comprising a tip 38, which sticks out upwards relative to the base. The clip 4 is embodied and/or arranged in such a manner and/or has a length based on the connecting member 14 such that it engages in the recess 8, penetrates the recess 8 across a significant part of its total length, and projects beyond the bottom side of the base 6.

As can furthermore be seen, the clip 4 is arranged so as to be inclined at a predetermined angle to the base 6, as long as neither cards nor tickets are inserted into the holding device. This predetermines a pretensioning. Even if only a sole card is inserted into the housing 2, the clip 8 is lifted out of the recess 8 in the direction of the arrow 40 and already fixedly holds this sole card in the housing 2 due to the predetermined pretensioning.

The pretensioning is predetermined due to the spring elasticity of the clip 4 and in addition, in a particularly advantageous manner via the connecting member 14, on which torsional forces act on the card or cards as well as banknotes via the clip 4, in particular because a base part is not present in the area of the connecting member 14.

The pressure or the force of the clip 4, respectively, is not only built up via the flexibility of the two clip parts 30, 32, but also by torsion of the connecting member 14. In addition, the two clip parts 30, 32 are involved in the optimized bendability and thus the application of the pretensioning force and/or the clamping force opposite the direction of the arrow 40.

The clip 4 and/or the clip parts 30, 32 furthermore have a thickness 42, which is larger than the thickness 44 on the free end 36, in the connecting area to the connecting member 14. The clip 4 thus has a thickness, which decreases towards the tip 38. The force is thus introduced in an advantageous manner at a favorable point in the front in the area of the tip 38 of the clip 4, so as to fix cards or tickets, which are inserted into the housing 2, in an advantageous area.

Due to the wall thicknesses of the clip 4, which decrease towards the tip 38, the contact point of the clip 4 moves significantly more easily in the direction of a smaller lever, depending on the height of the fill level with cards, to and/or based on the in particular curved area(s) 28, 29 and/or the connecting area of the clip 4 to the connecting member 14 and/or the housing 2. The front edges 46, 47 of the side members 10, 12 are arranged and set back towards the connecting member 14 towards the front edge 20 at a distance 48.

The front edges 46, 47 are furthermore rounded, so that the insertion of cards against the clip 4 into the housing 2 can be carried out in a particularly simple manner and easily into the housing 2 underneath the tip 38 of the clip 4, which is also embodied so as to be rounded.

FIG. 2 shows the holding device together with cards 50 and banknotes 52, which are inserted into the housing 2 and which are clamped together by means of the clip 4. The length 54 of the housing 2 is predetermined in such a manner that the cards 50 protrude from the housing 2 at a predetermined projection 56 and can thus be seized easily, if required, and can be taken out.

Due to the different height of both side members 10, 12, the banknotes 52 or documents or the like can furthermore rest on the upper edge of the lower second side member 12 and can also protrude laterally from the housing 2 with a projection 58. The higher side member 10 is preferably embodied in such a manner that substantially ten cards are guided well, wherein it is avoided that the cards 50 are pushed across the lower side member 12.

The lower side member 12 is advantageously embodied in such a manner that, in the event of fewer deposited cards, banknotes or documents or the like can stick out laterally without being too thick. Due to the asymmetric embodiment of the side members 10, 12 and thus of the housing 2, a secure storage of the tickets 52 or documents or the like and/or of the cards 50 is attained.

For removing one or a plurality of cards 50 of the illustrated stack, a user can use one finger, preferably two fingers or both thumbs, to push from the bottom side of the housing 2 through the recess 8 of the base 6 towards the clip 4, whereby the holding force applied by means of the clip 4 is minimized and the desired card 50 can be pushed out easily. A user hereby holds the housing 2 in his hand, for example using thumb and pinkie and uses the middle finger to push the card or cards, respectively, through the recess 8 slightly towards the top according to FIG. 2.

It goes without saying that a user cannot only push out the lowermost or the uppermost card of a card stack, but he can also remove a middle card, for example, wherein he first slightly removes one or a plurality of adjacent cards in the middle, so as to then push out the desired card completely. It is furthermore important to note that due to the sufficient flexibility of the banknotes or the like, only a single card is also held securely together with banknotes in the holding device due to the predetermined pretensioning of the clip 4.

FIG. 3 or FIG. 4, respectively, show the holding device in viewing direction A according to FIG. 1 without or with cards 50, respectively, and tickets 52. The housing 2 is embodied asymmetrically to the extent that the first side member 10 has the height 24, which is larger than the height 26 of the second side member 12, so that, according to FIG. 4, the tickets 52 protrude beyond the second side member 12 with the projection 58.

Due to the explained recess 8 in the base 6, the clip 4 engages partially through the recess 8 and protrudes with the tip 38 beyond the bottom side 60 according to FIG. 3. According to FIG. 4, the tickets 52 rest partially against the higher first side member 10 and rest on the upper edge of the shorter second side member 12 on the other side, so as to protrude laterally from the housing 2 with the projection 58.

Due to the asymmetric embodiment of the side walls or side members 10, 12, cards, in particular business cards can stick out, because business cards are often wider than credit cards by a predetermined amount of 1 mm or a few mm. In addition, it is particularly advantageous that the opposite corner of the projection and/or an inner corner has a very small radius, in particular because the embodiment without radius and/or a radius is virtually impossible in terms of production.

To be able to accommodate wider cards, such as business cards, the corner and/or the projection is required, whereby a narrow tolerance can be chosen in an advantageous manner for credit cards, so that they do not fall out too easily. In particular business cards thus do not end up with dog-ears and the tolerance for the width of the holding device or of the case can be dimensioned so as to be smaller, because business cards, which are larger than credit cards, can stick out.

It is furthermore important to note in particular that cards can preferably not only be inserted into the holding device or the case, respectively, from one side but from three sides, if required.

Figure 5:
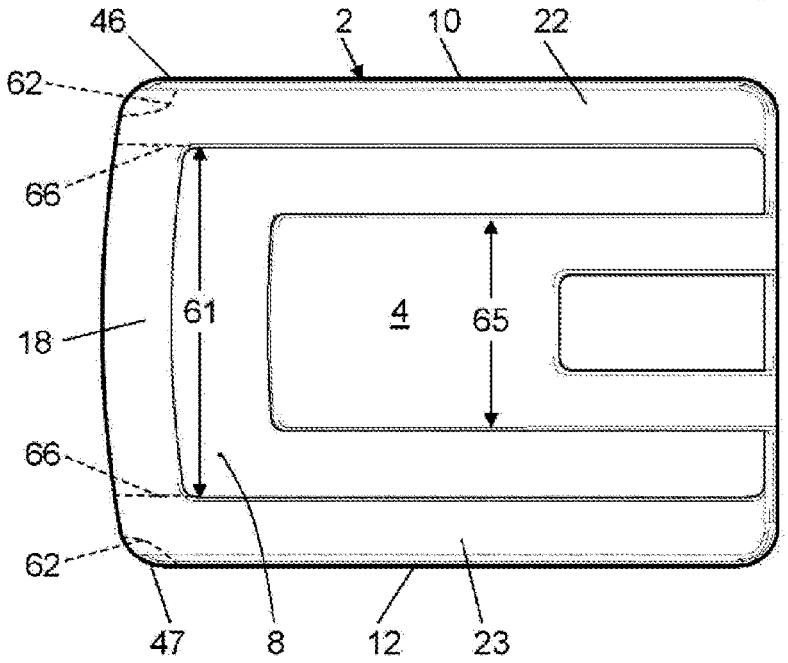
Figure 6:
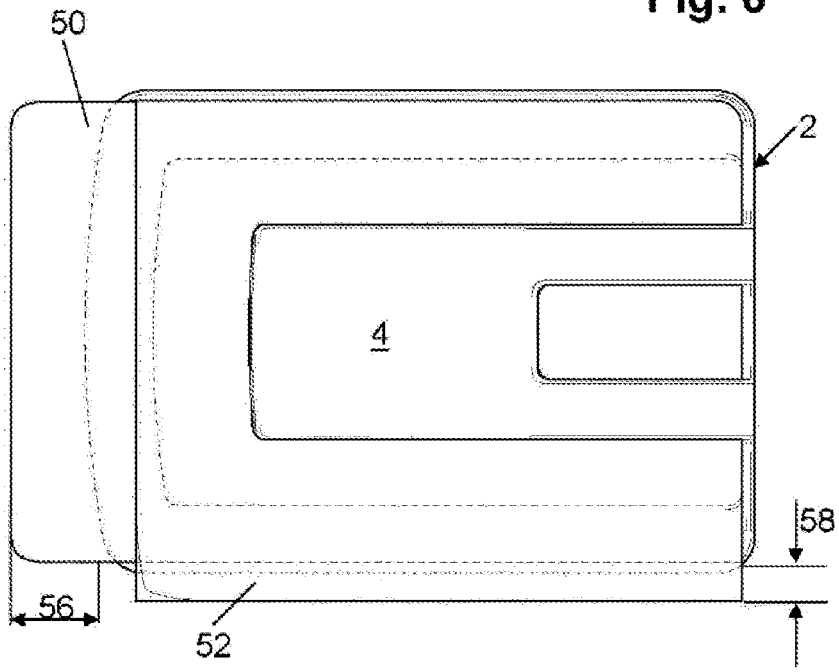

FIGS. 5 and 6 show views of the holding device in viewing direction B according to FIG. 1, wherein the recess 8, which is quite large and into which the clip 4 partially extends, can be seen well in FIG. 5. In FIG. 6 with the cards 50, the projection 56 thereof can be seen well and also the projection 58 of the tickets 52, which are clamped in the housing 2 by means of the clip 4.

The recess 8 has a width 61, which is significantly larger than the width 65 of the clip 4, namely such that free gaps are present to the lateral base parts 22, 23 on the side of the clip 4. As can further be seen from the drawing, a free gap is also present between the base part 18 and the front end of the clip 4. The mentioned gaps are predetermined in such a manner that a user can use one finger to reach through.

If cards are located in the housing 2, a user can use one finger to reach through one of the mentioned gaps and can press against the uppermost card of the card stack, so as to minimize the holding force or pretensioning force of the clip 4, so that the desired card can be slid out of the housing 2 more easily. The user can hereby not only remove the uppermost card, but can also remove the third card of the card stack, for example, wherein the two upper cards are preferably pushed out to the center and the third card can then finally be slid out very easily.

The holding device is embodied as frame, which has the two narrow lateral base parts 22, 23 and preferably the front base part 18 as well as the two side members 10, 12, which are connected to one another via the rear connecting member 14. The preferably rectangular recess 8 has the width 61, which is significantly larger than the width of the base parts 22, 23. Advantageously, the recess 8 ends on the rear connecting member 24, so that a base part is not present at that location and/or so that the frame-shaped housing 2 is held together via the rear connecting member 14.

The rear connecting member 14 connects the two side members 10, 12, which are connected to the lateral base parts 22, 23, preferably orthogonally. Based on the base 6, the housing 2, which is embodied as frame, is embodied so as to be open upwards towards the flexible clip 4, wherein the clip 4 reaches from the top to the base or to the recess 4 thereof, respectively, or engages through said recess, respectively.

An alternative embodiment is suggested in FIG. 5 by means of dashed lines, according to which provision is made in the area of the front edges 46, 47 of the side members 10, 12 for undercuts 62, which form latching elements for the purpose of locking the cards. The undercuts 62 or card catches are embodied in such a manner that cards can be pushed through between opposite catches 62.

In addition, the front base part 18 can additionally or alternatively be forgone, as is suggested by means of dashed lines 66. Due to the flexibility of the housing 2 and in particular of the side members 10, 12 thereof comprising the card catches, which are embodied as undercuts 62, the cards can be inserted into the housing 2 or can be removed therefrom easily, respectively.

Figure 7:
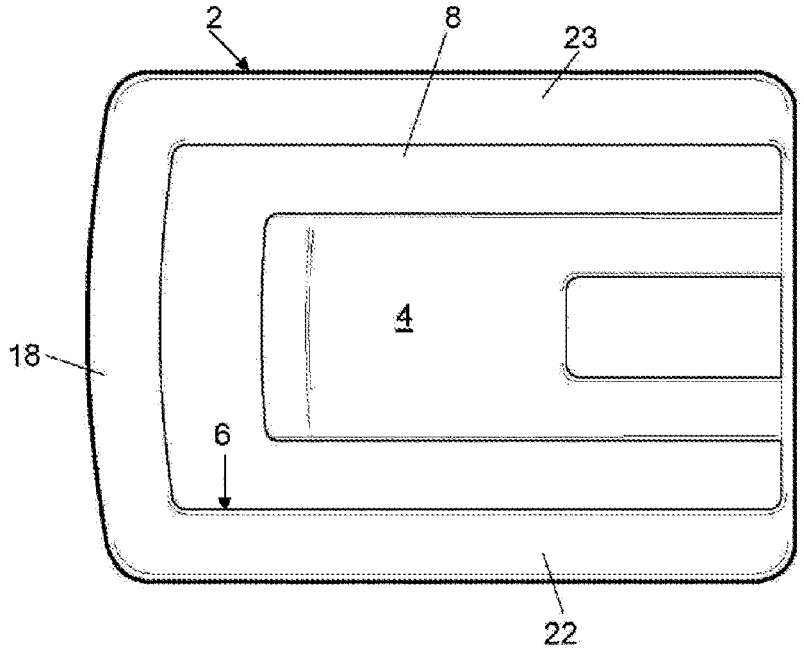
Figure 8:
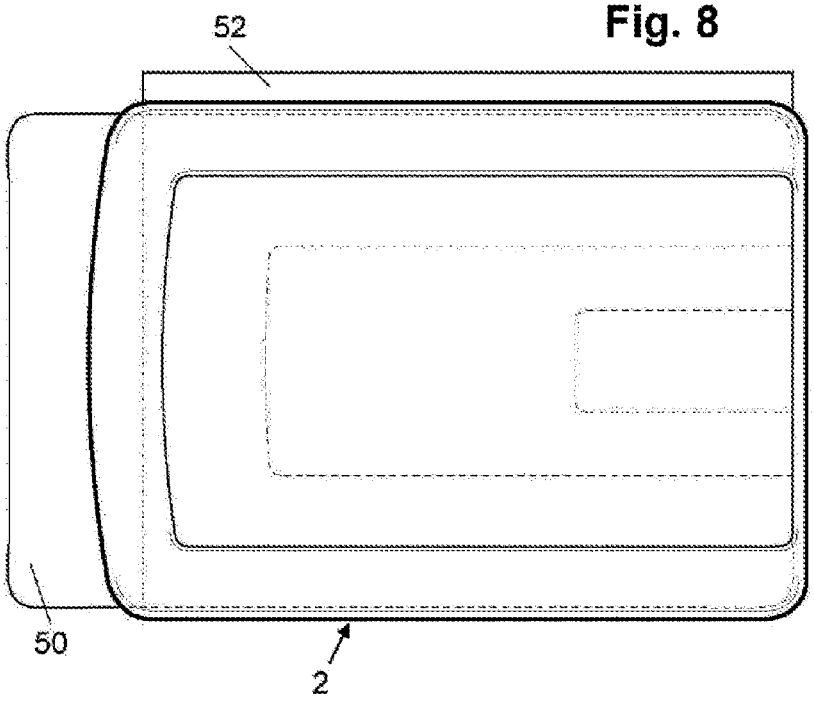

FIG. 7 or 8, respectively, show the holding device comprising the housing 2 of the clip 4 and the recess 8, wherein FIG. 7 illustrates the base part 23, which is assigned to the side member 12, and wherein the inserted cards 50 as well as the tickets 52 can again be identified according to FIG. 8.

The holding device fulfills the practical demands and/or objects with regard to simple handling for storing cards and/or tickets with little technical effort, wherein a functionally reliable accommodation as well as an easy removal thereof is attained. The holding device is furthermore characterized in an advantageous manner by a low weight and/or low material expenditure.

The asymmetric embodiment of the housing 2 and/or the embodiment of the mentioned side members 10, 12 comprising different heights is particularly significant, so that cards as well as banknotes or the like can be held securely by means of the clip 4 and can be removed easily from the holding device, if required.

Figure 9:
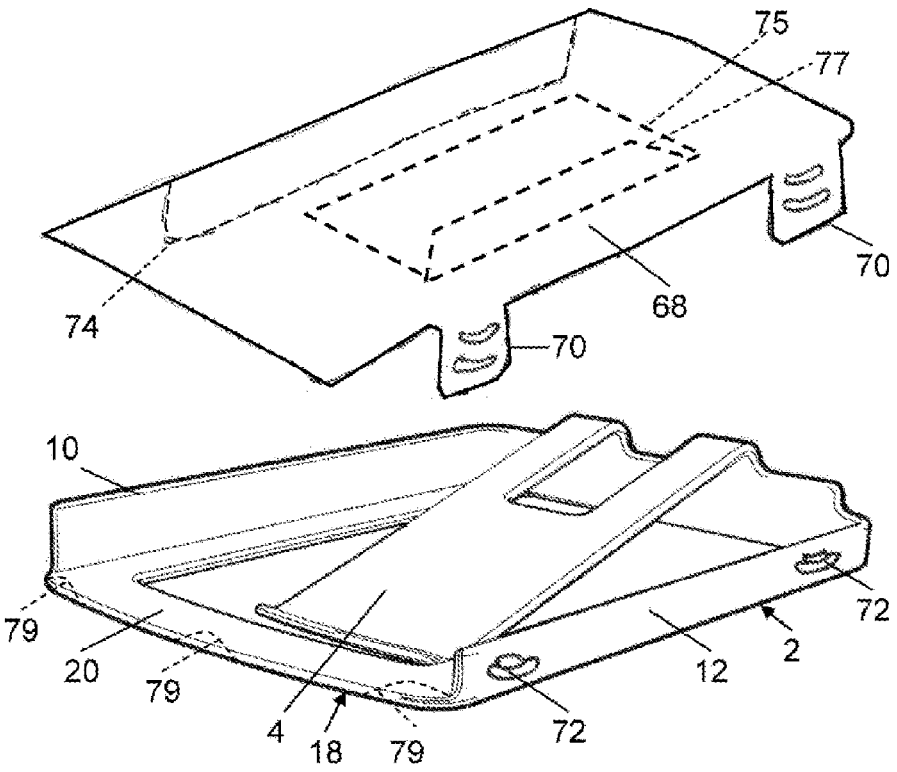
Figure 10:
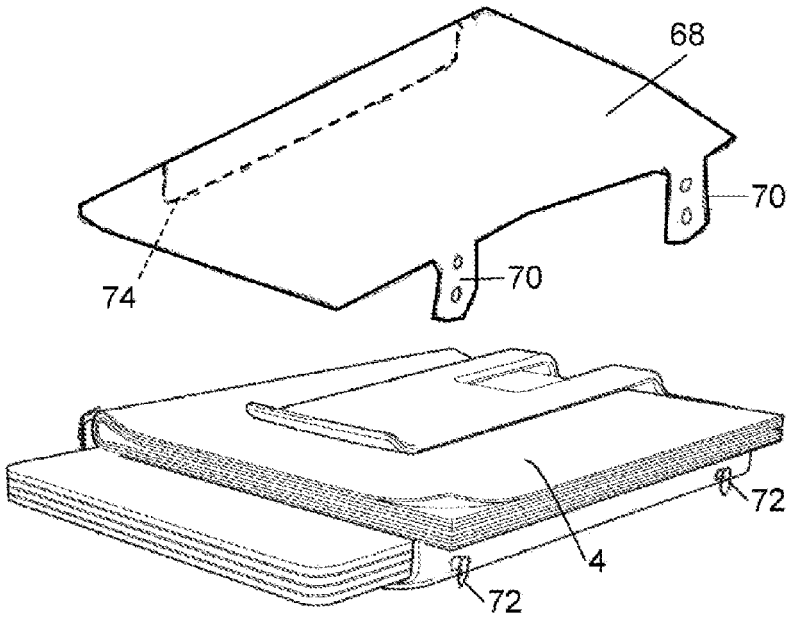
Figure 11:
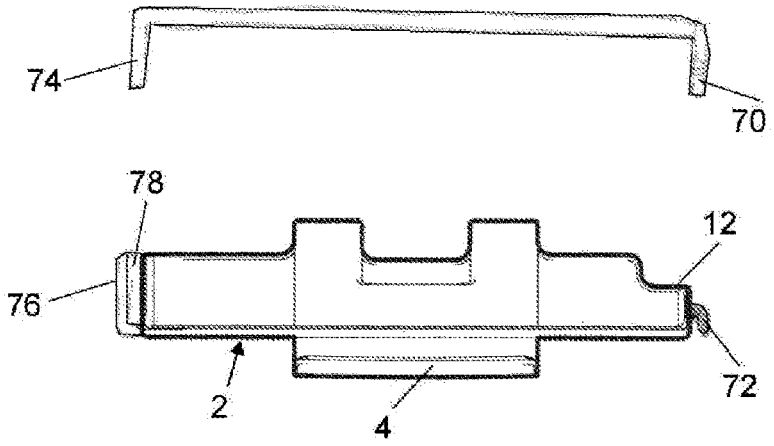

FIGS. 9 to 11 show special embodiments of the invention, according to which the holding device and/or the case has a cover 68. In the closed state, the cover 68 is on the top above the at least one clip 4 and cards and/or tickets, which might be inserted.

The flexible cover 68 includes at least one connecting body 70 and corresponding to the latter, the housing 2 has at least one connecting element 72, in particular on the second side member 12.

According to FIG. 9 and FIG. 10, two connecting bodies 70 and two connecting elements 72 are present. As can be seen, the clip 4 is covered by means of the cover 68 after establishing the connection of the cover 68 to the housing 2. The cover 68 consists at least partially of a flexible material, such as soft leather, felt, fur or plastic, and can be pivoted away from the housing 2 or the clip 4, respectively, if necessary, so that the tickets and/or cards are easily accessible to the user.

The cover 68 can alternatively consist of a largely non-deformable material, such as metal or hard plastic, for example, wherein the connecting body or the connecting bodies 70 are embodied as hinges and/or in addition hinges, in particular integral hinges, are present between the connecting body or the connecting bodies 70 and the cover 68.

Opposite to the connecting body or the connecting bodies 70, the cover 68 includes a tab 74 and, corresponding thereto, the housing 2 has a further member 76 on the first side member 10, namely spaced apart therefrom, by leaving a free space 78 or a groove 78. The tab 74 can engage in the free space 78 or the groove 78.

In an advantageous further development, the cover 68 can have a pocket 75 for change or coins, respectively, or other small parts, on the bottom side or on the upper side, as suggested in FIG. 9 by means of dashed lines.

Preferably, provision can be made for a flap 77 or another closure, for example snap fastener or zipper.

According to a further embodiment, the housing 2 can have at least one indentation 79, which is illustrated in a dashed manner, as insertion aid on the insertion side and/or in the base 6 and/or base part 18, whereby a simple insertion or removal of the card or of the cards is made possible. As illustrated, the at least one insertion aid or indentation 79 can be arranged in the corners and/or in the center, whereby it goes without saying that other positions of the respective indentation also lie within the scope of the invention.

In an alternative embodiment according to FIG. 11, the cover 68 can be inserted into the free space 78 or the groove 78 by means of the tab 74 and can be fixed at that location with regard to the housing 2, for example inserted and/or clamped and/or adhered. In the case of such an embodiment, the connecting bodies 70 or the connecting elements 72 are not provided for a permanent connection, but only to secure the cover 68 in the closed state.

If a user wants to remove cards or tickets from the holding device or the case, respectively, he can detach the connecting body or the connecting bodies 70 from the connecting element or the connecting elements 72 and can pivot the cover 68 away, wherein the connection of the tab 74 in the free space 78 or in the groove 78 remains. In another special embodiment, the tab and/or the cover 68 can be connected to the housing 2 by means of the further member 76 in the manner of a clamping rail, namely in particular in such a manner that the cover 68 can be connected easily to the housing 2 and can be changed, if required, and/or can be replaced by a different cover.

Figure 12:
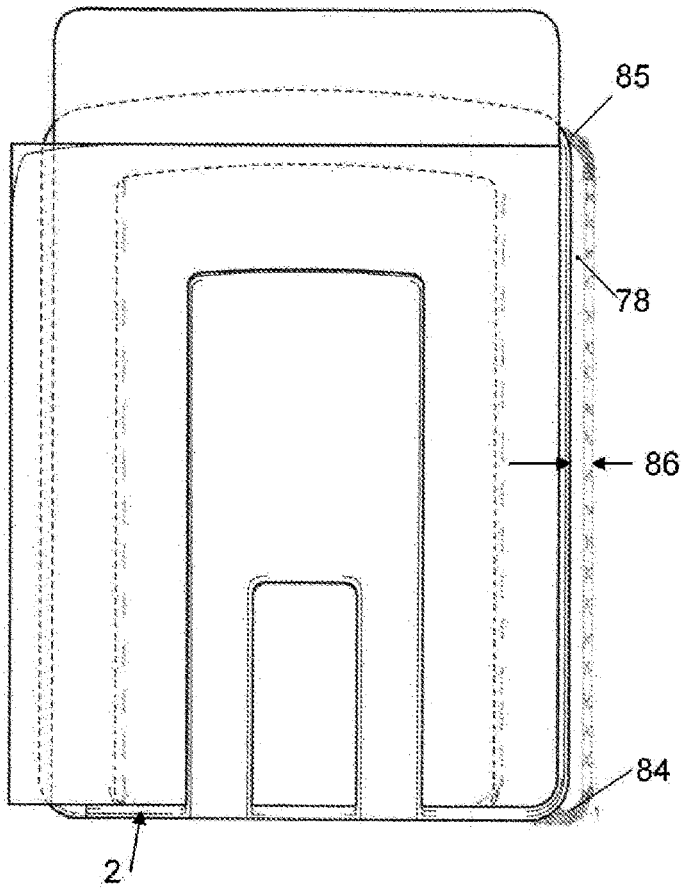
Figure 13:
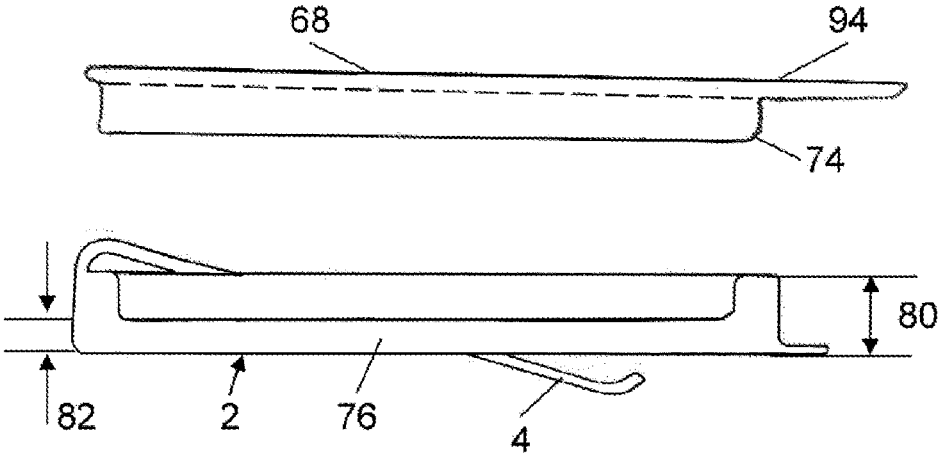

FIGS. 12 and 13 show an exemplary embodiment, the housing 2 of which includes the above-mentioned further member 76 for accommodating the tab and/or the side part 74 of the flexile cover 68. As is suggested in FIG. 12 by means of crossed lines, the further member 76 does not extend across the entire height 80 of the housing 2, but across a predetermined fraction 82. The fraction 82 lies in the range of between ¼ and ½ of the total height 80 and has at least approximately the value of ⅜.

As suggested in FIG. 12 by means of thick lines, the further member 76, however, extends in the preferably rounded corner areas 84, 85 substantially across the total height 80 of the housing 2. The side member 10 and the further member 76 thus form a double wall comprising a distance 86 according to the width of the groove 78. The cover 68 furthermore has a projection 94, which provides in particular for a simple seizing of the cover 68 for operation.

Figure 14:
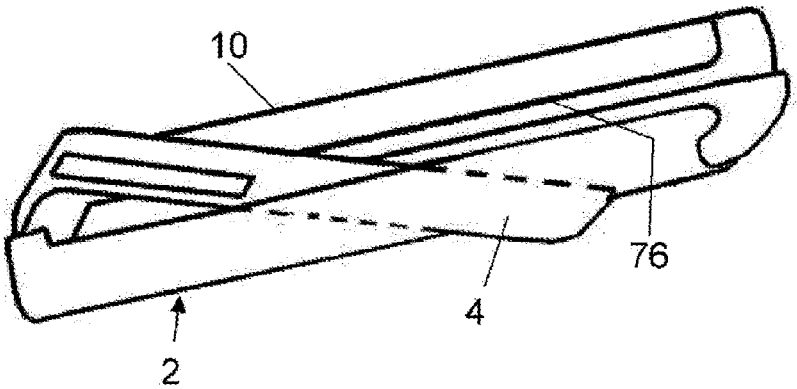

FIGS. 14 to 16 show an exemplary embodiment according to FIGS. 12 and 13, wherein provision is made on the longer side limitation and/or on the side member 10 for the inserting mechanism and/or the further member 76 comprising the free space 78 or the groove 78 for accommodating the connecting part of the cover 68 consisting of flexible and/or bendable material, in particular leather or plastic.

As can be seen, the cover 68 is advantageously fastened laterally to the housing 2 so as to cover the "cash side". An embodiment, which can be produced easily and/or in a simple manner and/or in a cost-efficient manner is created by this so as to carry many cards and/or optional tickets, such as cash, by means of the case. In the alternative, the insertion mechanism can furthermore be arranged on the connecting member 14 or can be assigned thereto.

FIG. 17 shows the cover 68 comprising lateral indentation 88 and the connecting part and/or connecting body 70 for being able to better fasten the cover 68. The connecting part or the connecting body 70, respectively, is inserted into the above-mentioned free space and is fastened in particular by means of adhesives. Due to the laterally adjoining indentation 88, the cover 68 can be fastened to the housing 2 in a simple and functionally reliable manner and/or can be connected thereto. The indentation 88 can enclose only the edge or can cover it according to or at material thickness, respectively, so that dog-ears are not bent upwards.

The indentation is advantageously embodied as pocket so as to enclose the edge and/or the connecting body 70 of the cover 68 in such a manner that the edges are overlapped. It is important to note here that the flexible cover 68 can preferably consist of leather, felt, neoprene, non-woven material, rubber, foam rubber, silicon or any comparable materials and/or of a combination of such materials, wherein in particular by means of the mentioned indentation 88, which is embodied as pocket, enclosure is possible in such a manner that the edges are overlapped.

It is attained through this in a particularly advantageous manner that, when changing the material, when leather is used, for example, and warps laterally of the bonding surface or other connecting means, the side edge, which is fastened in the housing 2, in particular in the free space thereof, or the connecting part 70 is surrounded reliably by the material, in particular plastic of the housing 2, and thus a clean and/or proper appearance and/or a functionally reliable connection is present.

A simple and easy mounting of the cover 68 is attained due to the recess of the indentation 88 and/or pocket and/or of the mentioned free space.

When inserting the cover 68 and/or the connecting part into the mentioned groove, it is furthermore made possible that a distance to an inner wall of the groove is predetermined, so as to in particular be able to apply the adhesive more easily and/or in a simple manner. The cover 68 has a length 90, which is larger by a predetermined amount than the length 54 of the housing explained by means of FIG. 2. The cover 68 thus has a projection 94, which provides for the simple seizing of the cover for pivoting away. Preferably, the length 92 of the projection 94 is at least equal in size, advantageously larger by a predetermined value than the projection 56 of the cards explained by means of FIG. 2. The specified dimensions are only exemplary and can be predetermined differently in the context of the invention, in particular as a function of the dimensions of the housing 2.

FIG. 18 shows a special embodiment of the cover 68, which, in addition or as an alternative to the projection 94, has a further projection 95 on the other end, wherein the connecting body 70 is present on the one longitudinal side. In an alternative embodiment, the connecting body 70 can be arranged instead of the projection 95, so that the cover 68 is arranged so as to be movable in longitudinal direction of the housing 2 and can be folded up or can be moved back, respectively, from the housing 2 or the cards and/or tickets stored therein, respectively.

FIG. 19 shows the housing 2 with inserted cards 50 and tickets 52, wherein the cover 68 is folded up and is pivoted away from said cards and tickets. If the cover 68 is pivoted back, the clips 4 as well as the tickets 52 and cards 50 are covered.

FIG. 20 illustrates the housing 2 in viewing direction onto the rear sides of the base 6 comprising the narrow base parts 18, 22, 23 and the large recess 8. Due to the predetermined size of the recess 8, a user cannot only use a thumb, but both thumbs to move or slide, respectively, or push and/or pull the cards 50.1 and 50.2 simultaneously. The user can carry this out until he sees the desired card from the stack of cards, which he can then pull out and/or remove completely from the housing 2 of the holding device.

Figure 21:
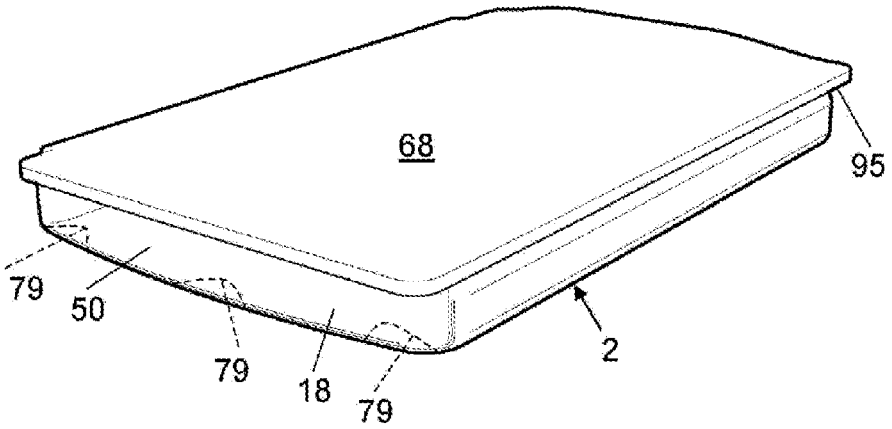
Figure 22:
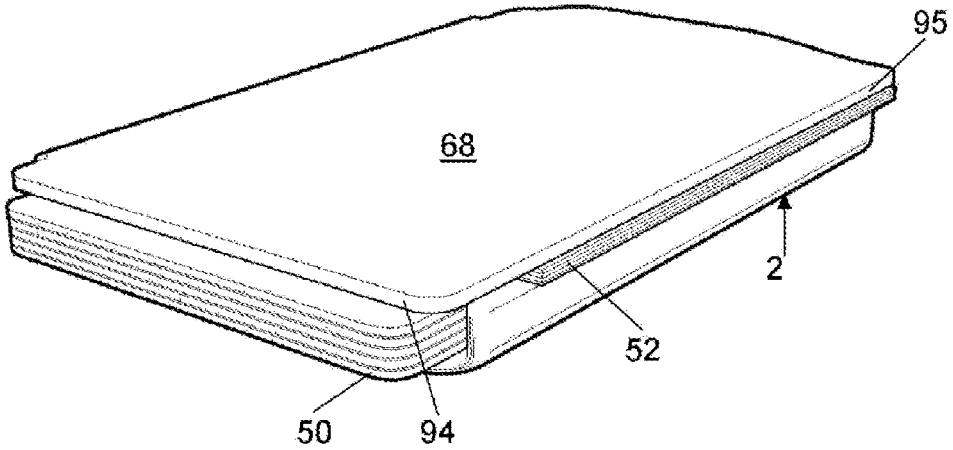

FIG. 21 shows the non-filled holding device or the case, respectively, while according to FIG. 22, cards 50 as well as tickets 52 are placed in the housing 2. The cover 68 is in each case illustrated in the closed position of the case, wherein the projections 94 and 95 can be seen well. The clip 4 for holding the cards 50 and tickets 52 in the housing 2 is located directly underneath the cover 68. As already explained, the housing 2 has at least one indentation as insertion aid on the insertion side in the base 6 and/or base part 18.

Figure 23:
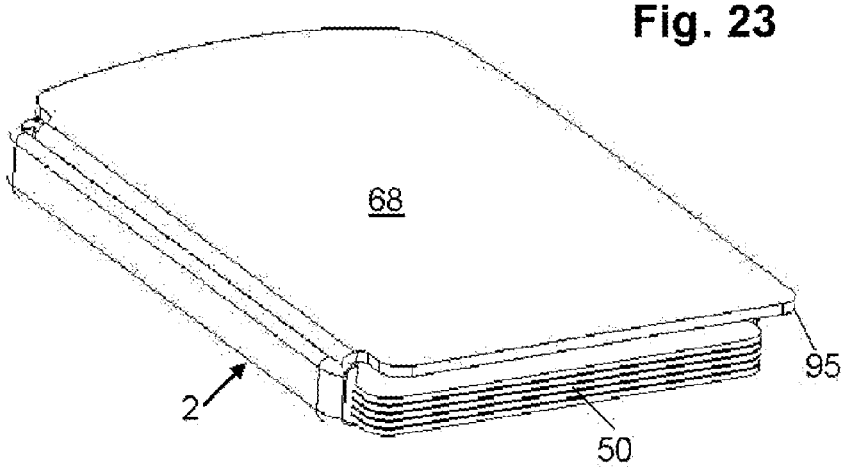

FIGS. 23 to 25 show perspective views of the holding device or of the case, respectively, comprising cards 50 inserted in the housing 2 and closed cover 68.

For a special embodiment of the housing 2 of metal, FIG. 26 shows the pre-cut prior to bending of the various components of the housing 2'. The bending zones of the various components, such as the clip 4, the side members or side walls 10, 12 and of the connecting member or of the connecting wall 14, respectively, are suggested by means of dashed lines. The recess 8 in the base 6 can also be seen well. In a preferable manner, the side members 10, 12 include end parts 96, which provide for the connection after the upwards bending according to FIG. 1. An additional member part 98, which can be bent over in such a manner that the groove or free space 78 explained above by means of FIG. 12 or 15 is formed for the connecting body of the cover 68, is furthermore located on the side member 10.

In a preferred alternative embodiment, the connecting body of the cover can in particular be introduced by bending over the member part 98 and/or can be clamped in a preferred manner.

In a special further development, the clip 4 has a depression 100 on the bottom side, wherein, after bending the clip 4, the mentioned bottom side comprising the depression 100 faces the tickets or cards or rests thereon, respectively. An insert, in particular made of felt or a different material, which is soft as compared to metal, is arranged in the depression 100 as protection for the tickets or cards. In addition or as an alternative, a varnish, advantageously flocked with soft flakes, can furthermore be arranged on the bottom side and/or in the depression 100, so that the cards or tickets are not damaged.

FIG. 27 illustrates a special embodiment of the connection of the partially illustrated flexible cover 68 comprising the tab 74. The second side member 12 includes the undercut groove 78, into which the cover 68 can be inserted with its tab 74 by means of an insertion body 102. The insertion body 102 is preferably embodied in a wedge-shaped manner such that, advantageously, the tolerance range between exchangeable covers, which preferably consist of leather, can easily be predetermined in an enlarged manner.

Starting at a handle or cover body 104, which is provided advantageously, the insertion body 102 is embodied so as to taper conically towards the tip 106 and includes journals 108, which stick out substantially radially. The cover 68 or the side part or tab 74 thereof, respectively, has holes 110, which are assigned to the mentioned journals 108. As is illustrated by means of the arrows 112, the insertion body 102 can be connected to the cover by means of the journals 108 and the holes and bores 110 and, according to arrow 114, can be inserted into the engaged-behind groove 78 for connection to the housing 2.

In the alternative, the insertion body 102 can be embodied so as to be slotted and the tab 74 can be clamped into the slot. In addition and/or in the alternative, the groove 78 can furthermore be embodied so as to taper and/or constrict in a tapered manner from the front base part 18 towards the rear connecting member 14, so as to be able to carry out the insertion of the insertion body 102 in a simple manner, wherein the maximal clamping is attained in the rear, and/or when the insertion body 102 is inserted almost completely into the groove 78. The front opening of the groove is covered in an advantageous manner by means of the handle or cover body 104, the outer contour of which is adapted to the contour of the side member 12. The insertion body 102 as well as the undercut groove 78 furthermore include latching elements, which preferably correspond to one another and/or which can be engaged with one another in such a manner that a functionally reliable fixing is ensured after completely inserting the cover 68 or the side part 74 or tab thereof, respectively.

FIG. 28 and FIG. 29 illustrate two special exemplary embodiments of the holding device which in each case have two clips 4, which are arranged on the connecting member 14 of the housing, which is long as compared to the exemplary embodiments explained so far, in an otherwise corresponding manner. The housing 2 includes the base comprising the recess 8, but the latter can also be foregone in the context of the invention.

In the case of the exemplary embodiment of FIG. 28, the comparatively short side member 10 includes the groove 78 for fixing the cover, which is not illustrated here. In the case of the insertion area, the base of the housing 2 has indentations 79 for facilitating the insertion or removal of cards.

In the case of the exemplary embodiment according to FIG. 29, the groove 78 for fixing a cover is arranged on the connecting member 14. In the context of the invention, provision can be made in the case of the exemplary embodiments of FIGS. 28 and 29 for the connecting bodies or connecting elements, which are explained by means of FIGS. 9 to 11, for fixing and/or connecting a cover.

It is furthermore important to point out that the cover is embodied analogously to the other explained exemplary embodiments in an advantageous manner such that inserted tickets and/or cards are covered according to the projections of the cover, which are explained in particular by means of FIGS. 17 and 18.

The exemplary embodiments explained by means of the drawings have features, which are illustrated and disclosed according to the above description as well as in the drawing. It should be stated expressly that each individual feature, which is explained and/or which can be gathered from the drawing, can be provided and/or combined in a sensible manner and/or for the respective requirement either alone or in combination with one of the other individual features in accordance with the invention. Every feature combination of the explained and/or illustrated individual features, which is suitable for solving the underlying object, is the subject matter of the present invention.

REFERENCE NUMERALS

E insertion width, illustrated in a dot-dash manner, in transverse direction of 2
K clamping length, illustrated in a dot-dash manner, in longitudinal direction of 2
2 housing
4 clip
6 base
8 recess
10 first side member
10*a* inner contact surface of 10
12 second side member
12*a* inner contact surface of 12
14 rear connecting member
16 front end
18 front base part
20 front edge of 18
22, 23 lateral base part
24 height of 10
26 height of 12
28, 29 curved area
30, 32 clip part
34 recess between 30, 32
36 free end of 4
38 curved tip of 4
40 arrow
42 thickness of 4 in the connecting area
44 thickness of 4 at 36
46, 47 front edge of 10, 12
48 distance
50 card
52 ticket/banknote
54 length of 2
56 projection of 50
58 projection of 52
60 bottom side of 6
61 width of 8
62 undercut/latching element
65 width of 4
66 dashed line
68 cover
70 connecting body
72 connecting element of 2
74 tab/side part
75 pocket
76 further member of 2
77 flap
78 free space/groove
79 indentation in 18
80 total height of 2
82 fraction of 80/height of 76
84, 85 corner area
86 distance/width of 78
88 indentation/pocket in 68
90 length of 68
92 amount of 94
94, 95 projection of 68
96 dashed line
98 member part
100 depression in 4
102 insertion body
104 handle/cover body
106 tip of 102
108 journal on 102
110 hole, bore
112 arrow
114 arrow

The invention claimed is:

1. A holding device for cards and/or tickets, containing an upwardly open housing (2), which has a base (6), wherein the base (6) has side members (10, 12), which protrude upwards and which are arranged at a distance to each other, wherein the inner contact surfaces (10*a*, 12*a*) of the side members (10, 12) are arranged parallel to one another, wherein the side members (10, 12) together with the base (6) form an insertion compartment which has, along a defined clamping length (K), an insertion width (E) in a lower area of the insertion compartment which is greater than 52 mm and less than 53.98 mm, wherein when a card and/or ticket is received in the insertion compartment, the side members (10, 12) clamp the card and/or ticket in a lateral direction, wherein the insertion width (E) in the lower area of the insertion compartment widens in an upward direction to an upper area of the insertion compartment, wherein the insertion width (E) in the upper area of the insertion compartment lies between 54 mm and 54.2 mm and/or widens from 53.98 mm in an intermediate area of the insertion compartment between the lower area of the insertion compartment and the upper area of the insertion compartment to a value that lies in the range between 54 mm and 54.2 mm in the upper area of the insertion compartment, and wherein at least one clip (4) is provided which engages from above into the upwardly open housing (2), wherein, if neither cards nor tickets are placed in the housing (2), the at least one clip (4) is situated partially between the side members (10, 12) and extends with a free end (36) at least approximately as far as the base (6).

2. The holding device as claimed in claim 1, wherein the clamping length (K) is at least 3 mm and no greater than 85.6 mm.

3. The holding device as claimed in claim 1, wherein the base (6) reversibly deformable and/or formed so as to be bulged or curved under pretension.

4. The holding device as claimed in claim 1, wherein a connecting member (14) of the housing (2) is, at least in certain portions, reversibly deformable and/or formed so as to be bulged or curved under pretension.

5. The holding device as claimed in claim 1, wherein the housing (2) is manufactured by means of a two-component injection molding process.

6. The holding device as claimed in claim 1, wherein the base (6) has a recess (8) through which, if neither cards nor tickets are placed in the housing (2), the at least one clip (4) engages with the free end (36).

7. The holding device as claimed in claim 6, wherein the recess (8) has a width (61), which is significantly larger than a width (65) of the at least one clip (4).

8. The holding device as claimed in claim 6, wherein the recess (8) is at least half as large as a surface between the side members (10, 12) and the front end (16) and the connecting member (14).

9. The holding device as claimed in claim 6, wherein the base has lateral base parts (22, 23), between which the recess (8) is located, and/or wherein the base parts (22, 23) are embodied so as to be narrow, and/or wherein the base parts (22, 23) have a smaller width than the side member (10) having a larger height (24).

10. The holding device as claimed in claim 1, wherein at least two clips (4) are provided, which are arranged at the side member (10, 12) or a connecting member (14).

11. The holding device as claimed in claim 1, wherein, provided that at least one card or one ticket will be or is placed in the housing (2), the at least one clip (4) is lifted and has a pretension, on the basis of which the at least one card and/or the at least one ticket is clipped to the base (6) under pretension.

12. The holding device as claimed in claim 1, wherein the side members (10, 12) have different heights such that tickets and/or cards can protrude out of the housing (2) beyond the side member (12) having a smaller height (26).

13. The holding device as claimed in claim 1, wherein the side members (10, 12) are connected to one another by means of a connecting member (14), wherein said side members and connecting member are arranged in a substantially U-shaped manner, and wherein cards can be inserted into the housing (2) or can be removed from the housing, respectively, at a front end (16), which is arranged opposite the connecting member (14).

14. The holding device as claimed in claim 13, wherein the at least one clip (4) is arranged at the connecting member (14), and/or wherein the at least one clip (4) is connected to said connecting member (14) via at least one curved area (28, 29).

15. The holding device as claimed in claim 14, wherein two curved areas (28, 29) are provided, and a recess (34) is present between said curved areas.

16. The holding device as claimed in claim 1, wherein the at least one clip (4) is arranged so as to be inclined at a predetermined angle to the base (6), as long as no card or ticket is placed in the housing (2).

17. The holding device as claimed in claim 1, wherein a length (54) of the housing (22) is predetermined such that cards (50), which are inserted or placed completely in the housing (2), protrude from the housing (2) at a predetermined projection (56).

18. The holding device as claimed in claim 1, wherein the card and/or ticket placed in the housing (2) project from the housing (2) at a predetermined projection (58) beyond the side member (12) having a smaller height (26).

19. The holding device as claimed in claim 1, wherein the at least one clip (4) is arranged and/or embodied such that the cards (50) as well as tickets (52) are clipped in the housing (2) and/or to the base (6) thereof by means of said at least one clip.

20. The holding device as claimed in claim 1, wherein a cover (68) is provided which is fastened to one of the side members (10, 12) or to a connecting member (14) of one of the side members.

21. The holding device as claimed in claim 20, wherein at least one cover (68) is of flexible design.

22. The holding device as claimed in claim 1, wherein a cover (68) is provided, which is detachably connected to a connecting element (72) of the housing (2) or a groove (78) of the housing (2), by means of at least one connecting body (70) or a tab (74).

23. The holding device as claimed in claim 22, wherein the housing (2) has a groove (78), in which the tab (74) is fixed.

24. The holding device as claimed in claim 22, wherein the cover is configured to be fixed in the groove (78) of the housing (2) by means of an insertion body (102).

25. The holding device as claimed in claim 1, wherein the clamping length (K) is at least 6 mm and no greater than 85.6 mm.

26. The holding device as claimed in claim 1, wherein the clamping length (K) is at least 10 mm and no greater than 85.6 mm.

* * * * *